US010933464B2

(12) United States Patent
Wu

(10) Patent No.: US 10,933,464 B2
(45) Date of Patent: Mar. 2, 2021

(54) FORGING CAST METHOD USING THIN SHELL MOLD

(71) Applicant: Cheng-Kuan Wu, Tainan (TW)

(72) Inventor: Cheng-Kuan Wu, Tainan (TW)

( * ) Notice: Subject to any disclaimer, the term of this patent is extended or adjusted under 35 U.S.C. 154(b) by 0 days.

(21) Appl. No.: 16/519,477

(22) Filed: Jul. 23, 2019

(65) Prior Publication Data

US 2021/0023612 A1 Jan. 28, 2021

(51) Int. Cl.

| | |
|---|---|
| ***B22D 18/04*** | (2006.01) |
| ***B22D 18/06*** | (2006.01) |
| ***B22C 9/04*** | (2006.01) |
| ***B22D 18/02*** | (2006.01) |
| ***B22C 9/03*** | (2006.01) |

(52) U.S. Cl.

CPC ..... *B22D 18/02* (2013.01); *B22C 9/03* (2013.01); *B22C 9/04* (2013.01); *B22D 18/04* (2013.01); *B22D 18/06* (2013.01)

(58) Field of Classification Search

CPC ..... B22D 18/04; B22D 18/06; B22D 27/13; B22C 9/04

See application file for complete search history.

(56) References Cited

U.S. PATENT DOCUMENTS

| | | | | |
|---|---|---|---|---|
| 5,299,619 | A * | 4/1994 | Chandley | B22D 27/04 164/133 |
| 6,932,145 | B2 * | 8/2005 | Frasier | B22C 9/02 164/122.2 |
| 2003/0024681 | A1 * | 2/2003 | Soderstrom | B22C 9/08 164/122.1 |
| 2017/0312813 | A1 * | 11/2017 | Wu | B22C 9/12 |

FOREIGN PATENT DOCUMENTS

| | | | | |
|---|---|---|---|---|
| GB | 2454010 | A * | 4/2009 | B22D 27/15 |

* cited by examiner

*Primary Examiner* — Kevin E Yoon

(74) *Attorney, Agent, or Firm* — Alan D. Kamrath; Karin L. Williams; Mayer & Williams PC

(57) ABSTRACT

A casting method includes preparing a thin shell mold which is sintered and placed in a box. Sands are buried in the box to encompass the thin shell mold. The pressure chamber is depressurized. The casting material is filled into the thin shell mold, such that the thin shell mold is disposed at a vacuum state. Then, the negative pressure of the pressure chamber is released. Then, the pressure chamber is pressurized, to form a pressure difference which presses the casting material to flow into the thin shell mold, thereby finishing the casting work. The temperature of the casting material is reduced, and the pressure in the pressure chamber is increased. Then, the casting material is cooled to form a casting product. Then, the thin shell mold is broken, and the casting product is removed.

5 Claims, 10 Drawing Sheets

FORGING CAST METHOD USING THIN SHELL MOLD

BACKGROUND OF THE INVENTION

1. Field of the Invention

The present invention relates to a molding method of a metallic mold and, more particularly, to a forging cast (or squeeze casting) method using a thin shell mold.

2. Description of the Related Art

A conventional casting process comprises gravity casting and low pressure casting. In the gravity casting, a metal is melted and poured into a casting die. Then, the melted metal is solidified to form a casting product. Thus, the gravity casting is worked simply to save the cost. However, the gravity casting wastes material. In addition, air is introduced during the casting process, thereby decreasing the quality of the product. In the low pressure casting, liquid casting material is filled into a die, to perform a casting work under a negative pressure. Thus, the casting work is performed under the negative pressure, to prevent from introducing the air, such that the casting product has a clean surface. A ceramic mold is formed by a dewaxing method and has a fine surface. However, the ceramic mold has a complicated working process. In addition, the ceramic mold cannot tolerate a high pressure. A forging cast (or squeeze casting) method comprises filling a melted metal into a mold, applying a high pressure before the melted metal is solidified, such that the melted metal is solidified under the high pressure. Thus, the casting product formed by the forging cast method has a precise size, and will not produce cracks during the casting process. However, the forging cast method is only available for a mold with greater thickness and strength to withstand the high pressure. In addition, the mold the forging cast method has an expensive price. Further, the metal mold dissipates the heat quickly, such that the inner face and the outer face of the casting product are not cooled evenly.

BRIEF SUMMARY OF THE INVENTION

The primary objective of the present invention is to provide a forging cast method using a thin shell mold, wherein the casting material is filled and casted in the thin shell mold by a pressure differential, and is cooled under a positive pressure to form the casting product, thereby preventing the thin shell mold from being broken when subjected to the pressure.

In accordance with the present invention, there is provided a casting method comprising a first step of preparing a mold, a second step of sintering, a third step of depressurizing, a fourth step of filling, a fifth step of pressurizing, a sixth step of molding, and a seventh step of finishing work. The first step includes preparing a thin shell mold and a pressure chamber. The thin shell mold is made of ceramic material and has a thickness of 0.5-2.0 mm. The thin shell mold has an upper end provided with a sprue having a diameter of 25-45 mm. The thin shell mold has a periphery provided with a plurality of support brackets. The thin shell mold has a smooth inner surface and a rough outer surface. The pressure chamber has an interior provided with a furnace and a box. The furnace is provided with a feeding device. The box is provided with a temperature control device. The second step includes sintering the thin shell mold at a temperature under 600° C. The third step includes placing the thin shell mold in the box, then burying sands in the box to encompass and support the thin shell mold, then depressurizing and keeping a negative pressure in the pressure chamber at a value of −0.002 MPA to −0.05 MPA, and then turning on the temperature control device to heat the box under the negative pressure of the pressure chamber. The sands closely compress the thin shell mold and the support brackets. The rough outer surface of the thin shell mold touches the sands to increase a contact area between the thin shell mold and the sands. The fourth step includes melting casting material in the furnace of the pressure chamber under the negative pressure of the pressure chamber, and then filling the casting material through the feeding device of the furnace and the sprue of the thin shell mold into the thin shell mold. The feeding device of the furnace squeezes the casting material at a pressure of 10-20 KG/cm$^2$ to cover the sprue of the thin shell mold. The casting material is filled into the sprue of the thin shell mold to isolate an inner space of the thin shell mold from the pressure chamber, such that the inner space of the thin shell mold is disposed at a vacuum state. The fifth step includes stopping filling the casting material, then releasing the negative pressure of the pressure chamber, then introducing air into the pressure chamber to pressurize the pressure chamber, then forming a pressure difference between the inner space of the thin shell mold and the pressure chamber to press the casting material to further flow into the inner space of the thin shell mold, and then finishing a casting work after the casting material stops flowing. The sixth step includes turning off the temperature control device to reduce the temperature of the casting material in the thin shell mold, then increasing the pressure in the pressure chamber to a positive value of 80-100 KG/cm$^2$, to squeeze the casting material in the thin shell mold, and then cooling the casting material to form a casting product. The casting material is forced by the pressure of the pressure chamber to press an inner wall of the thin shell mold, and the sands in the box are forced by the pressure of the pressure chamber to press an outer wall of the thin shell mold. The casting material closely press the inner wall of the thin shell mold, such that the casting product has a smooth and clean surface. The seventh step includes removing the thin shell mold from the box, then breaking the thin shell mold, and then removing the casting product from the thin shell mold.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Referring to FIGS. 1-10, a casting method in accordance with the preferred embodiment of the present invention comprises a first step S1 of preparing a mold, a second step S2 of sintering, a third step S3 of depressurizing, a fourth step S4 of filling, a fifth step S5 of pressurizing, a sixth step S6 of molding (or forming or shaping), and a seventh step S7 of finishing work.

Figure 1:
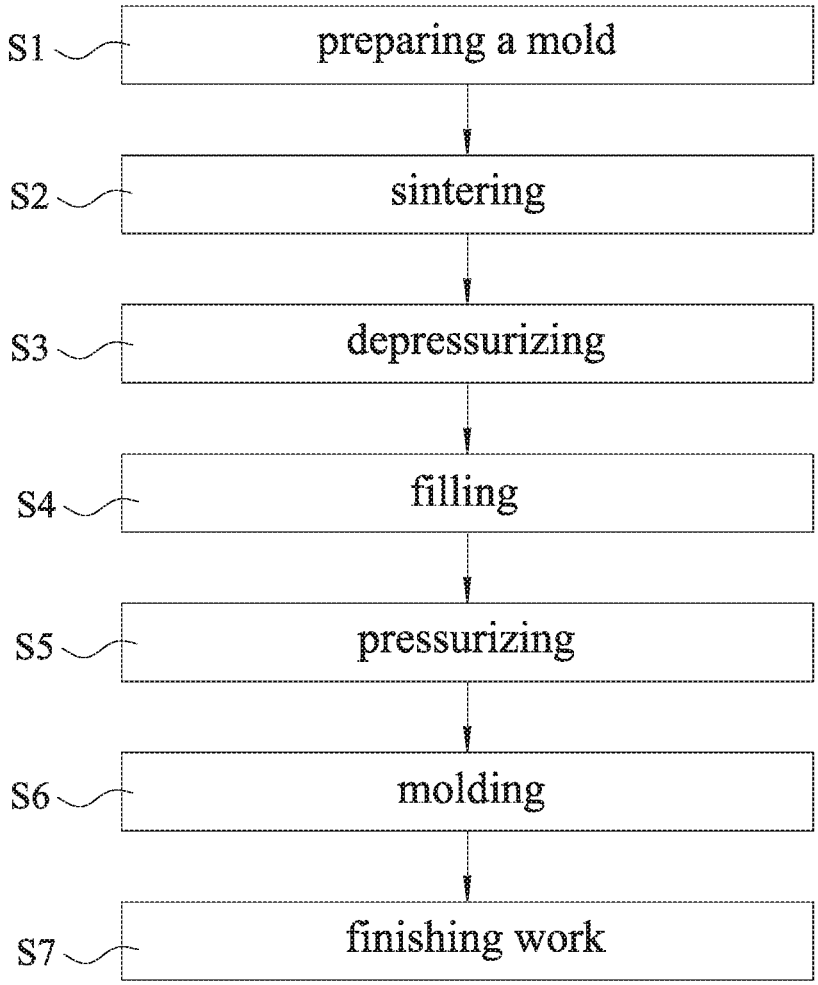
FIG. 1 is a flow chart of a casting method in accordance with the preferred embodiment of the present invention.
Figure 2:
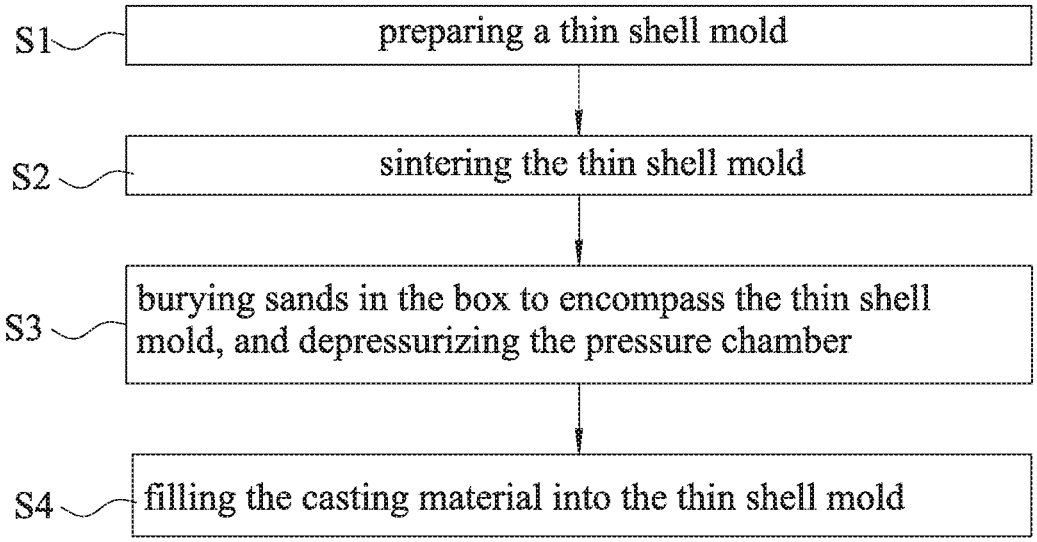
FIG. 2 is a flow chart of steps S1 to S4 of the casting method in accordance with the preferred embodiment of the present invention.
Figure 3:
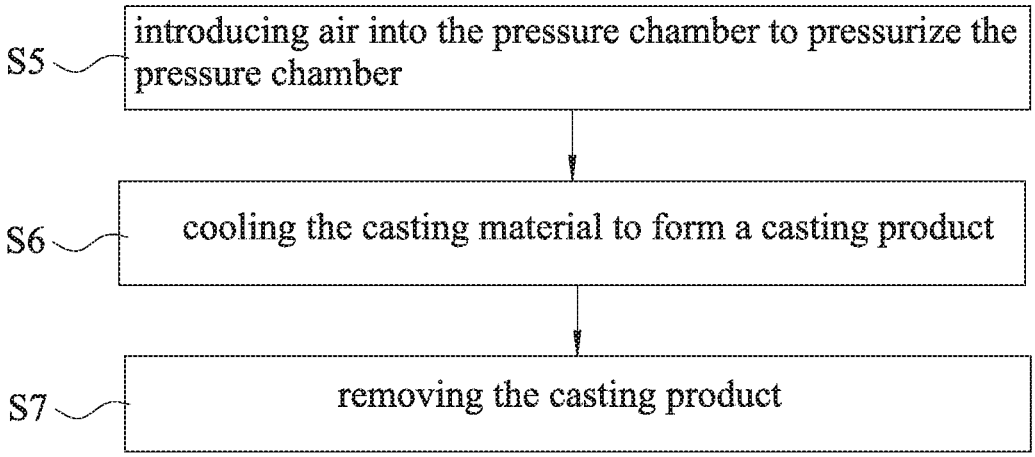
FIG. 3 is a flow chart of steps S5 to S7 of the casting method in accordance with the preferred embodiment of the present invention.
Figure 4:
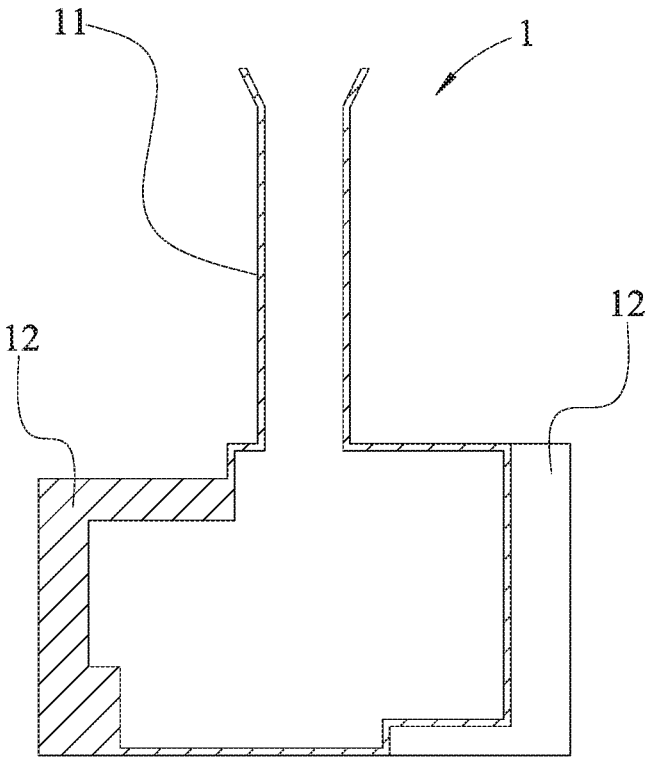
FIG. 4 is a cross-sectional view of a thin shell mold in accordance with the preferred embodiment of the present invention.
Figure 5:
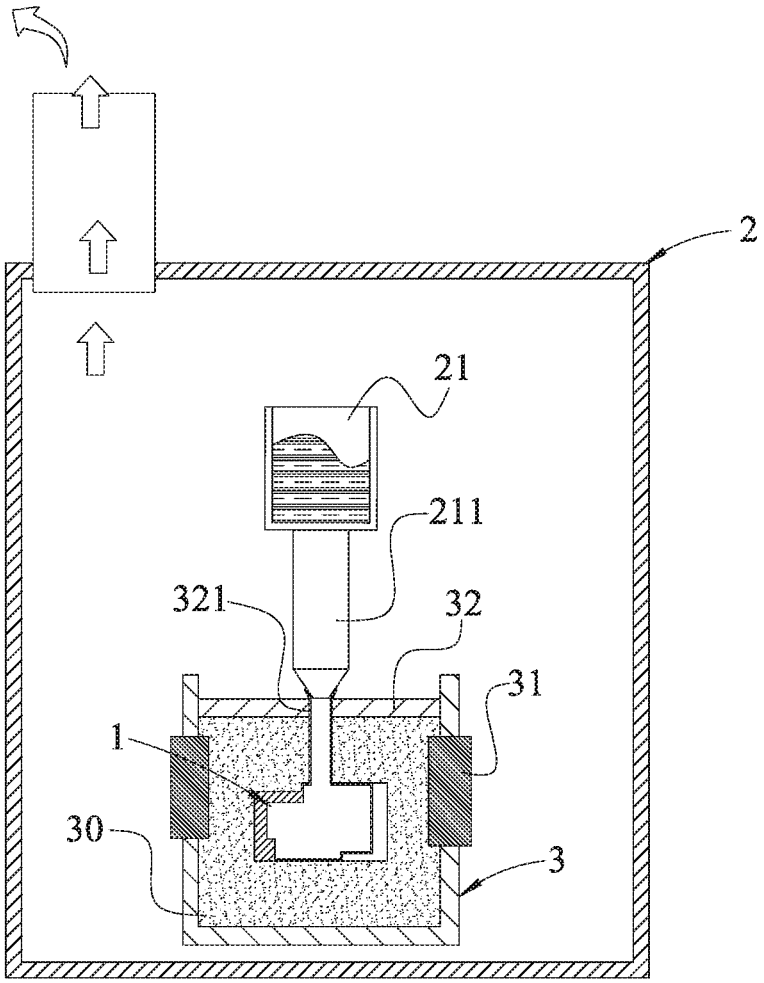
FIG. 5 is a cross-sectional operational view showing the pressure chamber is depressurized in accordance with the preferred embodiment of the present invention.

The first step S1 includes preparing a thin shell mold 1 (see FIG. 4) and a pressure chamber 2 (see FIG. 5). The thin shell mold 1 is made of ceramic material and has a thickness of 0.5-2.0 mm. The thin shell mold 1 has an upper end provided with a sprue (or gate) 11 having a diameter of 25-45 mm. The thin shell mold 1 has a periphery provided with a plurality of support brackets 12 which are arranged in a vertical direction. The thin shell mold 1 has a smooth inner surface and a rough outer surface. A dilute slurry is poured into the thin shell mold 1, with a surplus slurry being introduced outward from the thin shell mold 1. Thus, the smooth inner surface is formed in the thin shell mold 1 after the slurry is dried. The pressure chamber 2 has an interior provided with a furnace 21 and a box 3. The furnace 21 is provided with a feeding device 211. The box 3 is provided with a temperature control device 31 to control the temperature in the box 3.

The second step S2 includes sintering (or agglomerating) the thin shell mold 1 at a temperature under 600° C. The sintering process strengthens the thin shell mold 1 to withstand thermal expansion and contraction, thereby preventing the thin shell mold 1 from being broken due to the thermal expansion and contraction. The thin shell mold 1 is sintered at a low temperature, to prevent vitrification.

As shown in FIG. 5, the third step S3 includes placing the thin shell mold 1 in the box 3, then burying sands 30 in the box 3 to encompass and support the thin shell mold 1, then depressurizing and keeping a negative pressure in the pressure chamber 2 at a value of −0.002 MPA to −0.05 MPA, and then turning on the temperature control device 31 to heat the box 3 under the negative pressure of the pressure chamber 2. The sands 30 closely compress the thin shell mold 1 and the support brackets 12. The rough outer surface of the thin shell mold 1 touches the sands 30 to increase a contact area between the thin shell mold 1 and the sands 30. The sands 30 and the rough outer surface of the thin shell mold 1 conduct and distribute a heat to the thin shell mold 1 evenly to enhance the heat conduction.

Figure 7:
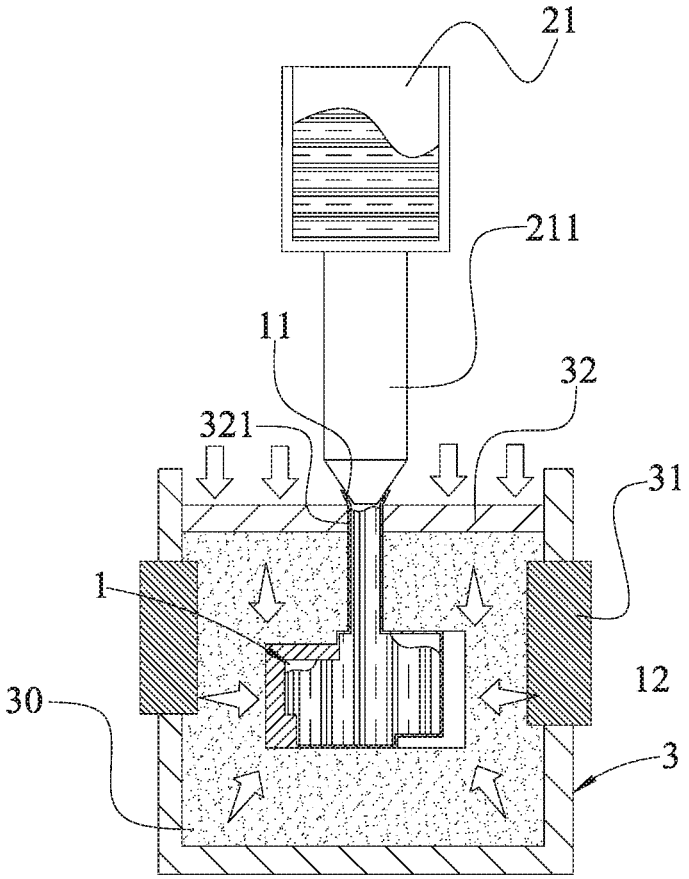
FIG. 7 is a cross-sectional operational view showing the casting material is filled and pressed in accordance with the preferred embodiment of the present invention.

As shown in FIG. 7, the fourth step S4 includes melting casting material in the furnace 21 of the pressure chamber 2 under the negative pressure of the pressure chamber 2, and then filling the casting material through the feeding device 211 of the furnace 21 and the sprue 11 of the thin shell mold 1 into the thin shell mold 1. The feeding device 211 of the furnace 21 squeezes and fills the casting material at a pressure of 10-20 KG/cm$^2$ to cover the sprue 11 of the thin shell mold 1 by the casting material. The casting material is filled into the sprue 11 of the thin shell mold 1 to isolate an inner space of the thin shell mold 1 from the pressure chamber 2, such that the inner space of the thin shell mold 1 is disposed at a vacuum state.

Figure 8:
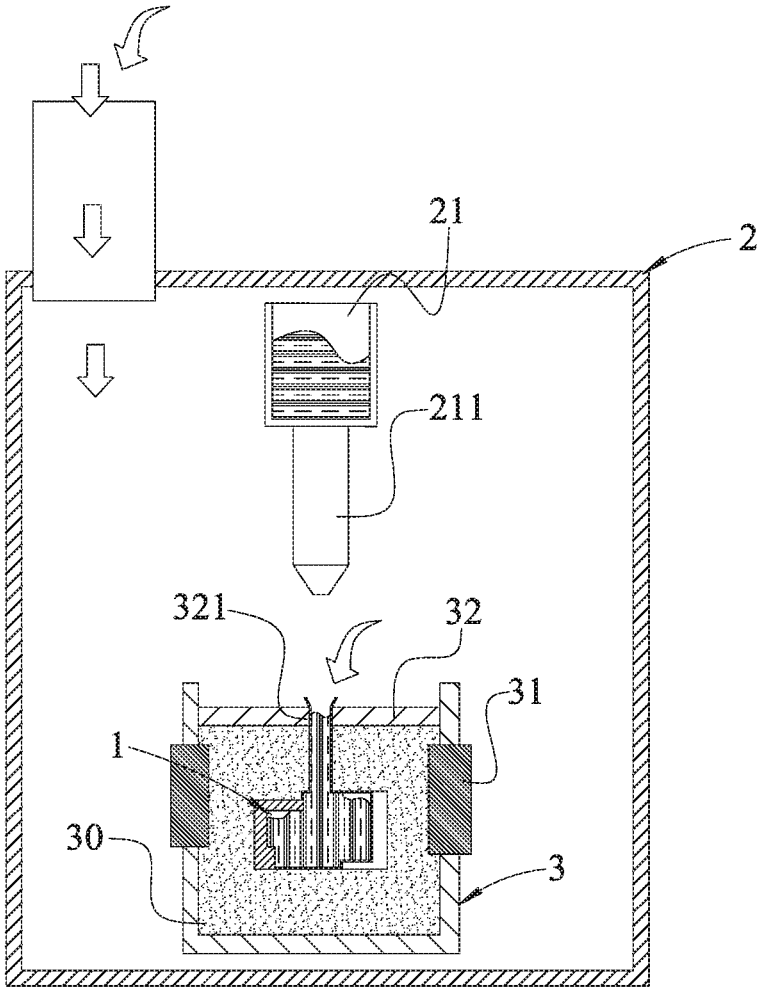
FIG. 8 is a cross-sectional operational view showing the pressure chamber is pressurized in accordance with the preferred embodiment of the present invention.

As shown in FIG. 8, the fifth step S5 includes stopping filling the casting material, then removing the feeding device 211 of the furnace 21 from the sprue 11 of the thin shell mold 1, then releasing the negative pressure of the pressure chamber 2, then introducing air into the pressure chamber 2 to pressurize the pressure chamber 2, then forming a pressure difference between the inner space of the thin shell mold 1 and the pressure chamber 2 to press the casting material to further flow into the inner space of the thin shell mold 1, and then finishing a casting work after the casting material stops flowing.

Figure 9:
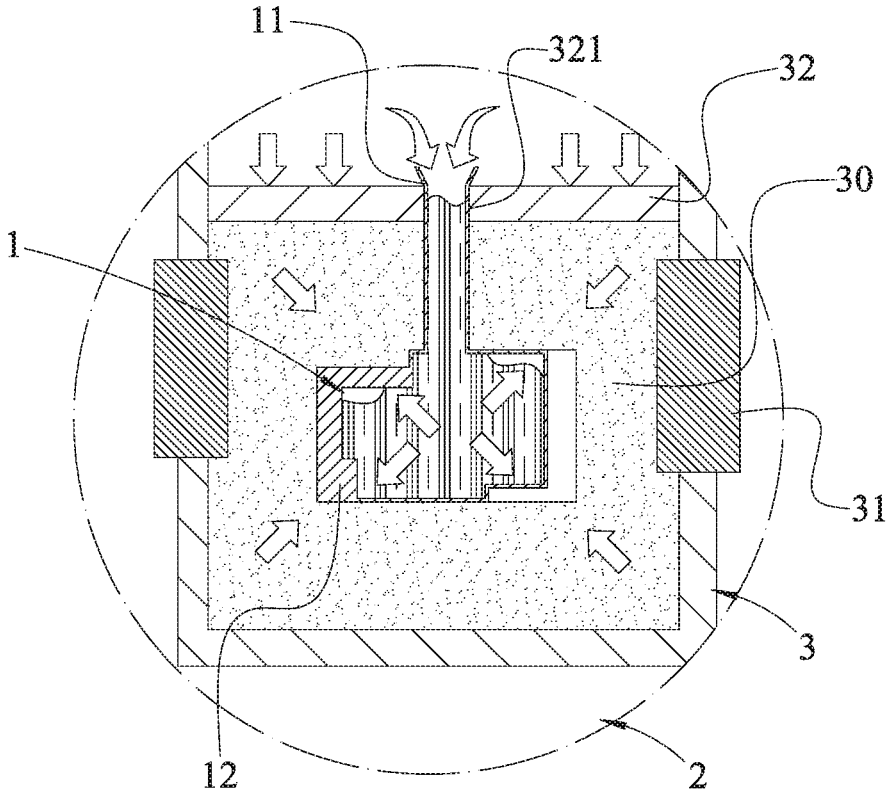
FIG. 9 is a locally enlarged cross-sectional operational view showing a pressurizing state in accordance with the preferred embodiment of the present invention.
Figure 10:
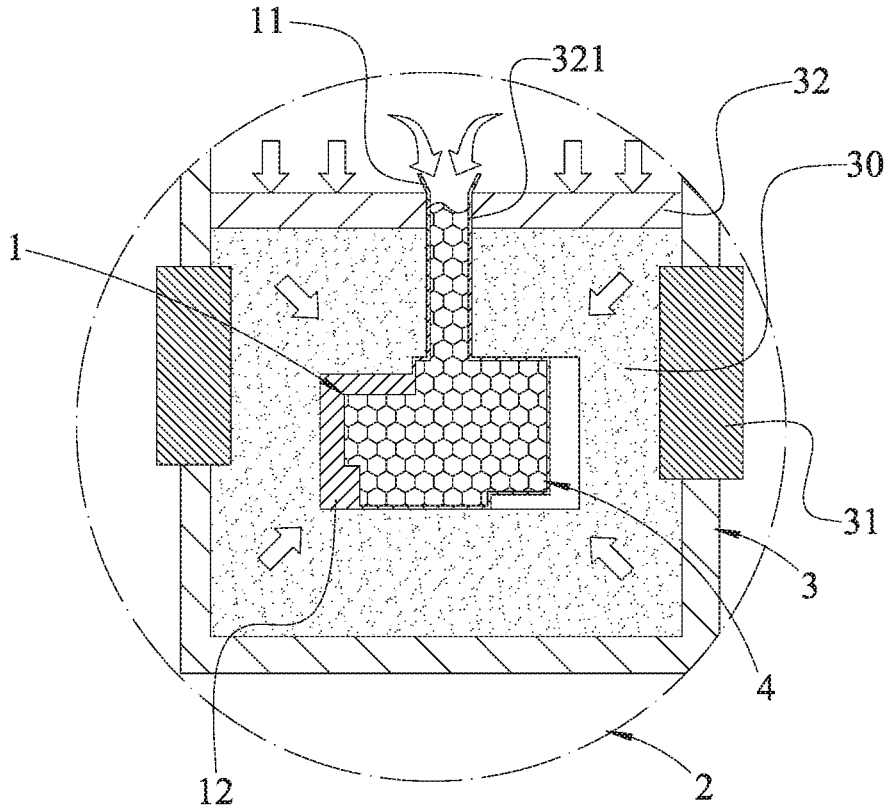
FIG. 10 is another locally enlarged cross-sectional operational view showing a pressurizing state in accordance with the preferred embodiment of the present invention.

Referring to FIG. 9 with reference to FIG. 8, the sixth step S6 includes turning off the temperature control device 31 to reduce the temperature of the casting material in the thin shell mold 1, then increasing the pressure in the pressure chamber 2 to a positive value of 80-100 KG/cm$^2$, to squeeze the casting material in the thin shell mold 1, and then cooling the casting material to form a casting product 4 as shown in FIG. 10. The casting material is forced by the pressure of the pressure chamber 2 to press an inner wall of the thin shell mold 1, and the sands 30 in the box 3 are forced by the pressure of the pressure chamber 2 to press an outer wall of the thin shell mold 1 as shown in FIG. 9, such that the thin shell mold 1 is compressed between the casting material and the sands 30 to form a pressure balance, thereby preventing the thin shell mold 1 from being damaged due to a pressure difference. The casting material closely press the inner wall of the thin shell mold 1, such that the casting product 4 has a smooth and clean surface.

The seventh step S7 includes removing the thin shell mold 1 from the box 3, then breaking the thin shell mold 1, and then removing the casting product 4 from the thin shell mold 1.

In the fourth step S4, the casting material in the furnace 21 of the pressure chamber 2 is disposed at a semisolid state. The fifth step S5 further includes successively heating the casting material in the thin shell mold 1 by the temperature control device 31 during a period of 2-7 minutes after the casting work is finished, and then increasing the pressure in the pressure chamber 2 to 25-30 KG/cm$^2$, such that the thin shell mold 1 and the casting material are combined closely. In the sixth step S6, when the casting material is cooled, a contraction rate of the casting material is reduced.

In the first step S1, the box 3 has an upper end provided with a cover 32 which has a through hole 321 allowing passage of the sprue 11 of the thin shell mold 1.

Figure 6:
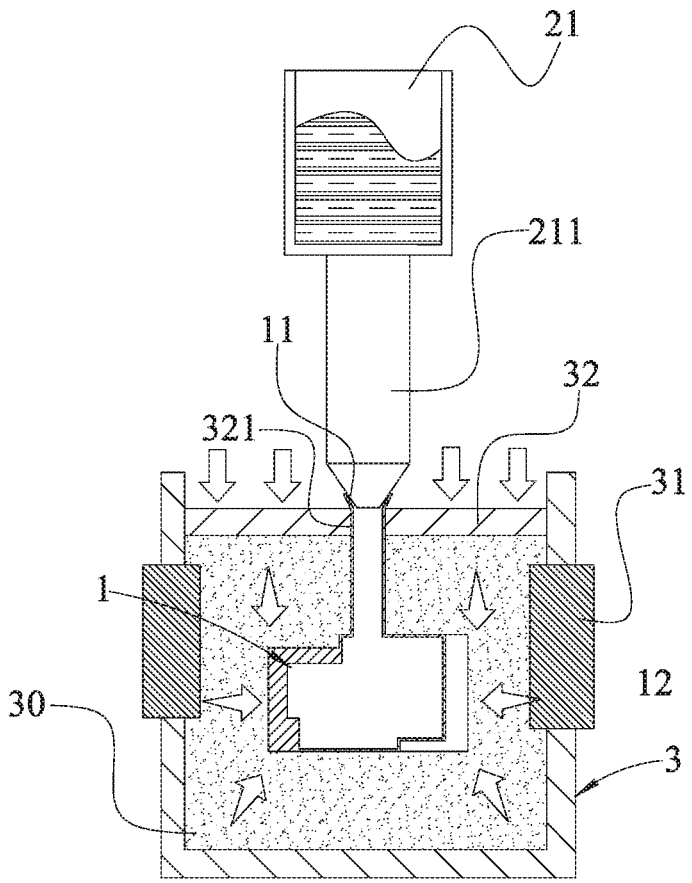
FIG. 6 is a cross-sectional operational view showing the cover is pressed in accordance with the preferred embodiment of the present invention.

The fifth step S5 further includes applying a pressure of 5-15 KG/cm$^2$ on the cover 32 as shown in FIG. 6, and then forcing the sands 30 to apply a pressure on the thin shell mold 1 evenly. As shown in FIG. 7, the casting material is filled into the sprue 11 of the thin shell mold 1 under the pressurized condition.

In the fifth step S5, when the air is introduced into the pressure chamber 2, the pressure in the pressure chamber 2 exceeds the atmospheric pressure and is kept at 15-50 KG/cm$^2$, during a period of 2-5 minutes, such that the casting material in the sprue 11 of the thin shell mold 1 is subjected to the pressure in the pressure chamber 2 to fill the inner space of the thin shell mold 1, and the thin shell mold 1 is heated successively.

It is appreciated that, the thin shell mold 1 is made of ceramic material that is not available for a high pressure working condition of a forging cast (or squeeze casting) process. In the present invention, the inside of the thin shell mold 1 presents a negative pressure, and the outside of the thin shell mold 1 presents a positive pressure, such that the thin shell mold 1 made of ceramic material can be used in the forging cast process by using the pressure differential of the thin shell mold 1. Thus, the thin shell mold 1 has a small thickness to save the cost of material.

In fabrication, the thin shell mold 1 is formed by a dewaxing method or by a 3-D printing machine. The thin shell mold 1 has a thickness of 0.5-2.0 mm to save the ceramic material. The sprue 11 of the thin shell mold 1 has a diameter of 25-45 mm to reduce a hydraulic jump action during the casting process, thereby preventing the casting product 4 from being damaged. The support brackets 12 support the thin shell mold 1 and will not obstruct the heating effect. The thin shell mold 1 has a smooth inner surface such that the casting product 4 has a smooth surface. Then, the thin shell mold 1 is sintered such that the thin shell mold 1 withstands a high pressure. In addition, the thin shell mold 1 is sintered at a low temperature, such that the thin shell mold 1 withstands a temperature differential. Then, the sands 30 are buried into the box 3, to encompass and support the outside of the thin shell mold 1. Then, the pressure chamber 2 is depressurized and kept at the negative pressure of −0.002 MPA to −0.05 MPA. Then, the temperature control device 31 heats the box 3 under the negative pressure, such that the sands 30 conduct and transmit the heat to the thin shell mold 1 evenly. The thin shell mold 1 has a small thickness, such that the heat is distributed on the thin shell mold 1 quickly, to perform a preheat process. Then, the casting material is heated and melted. Then, the casting material is filled through the sprue 11 into the thin shell mold 1, and the feeding device 211 of the furnace 21 pressurizes the casting material at a pressure of 10-20 KG/cm$^2$ to fill the casting material into the thin shell mold 1. At this time, the sands 30 and the support brackets 12 support the thin shell mold 1 to counteract the force applied by the casting material. Then, the casting material is filled with and covers the sprue 11 of the thin shell mold 1 to isolate the inner space of the thin shell mold 1 from the pressure chamber 2, such that the unfilled inner space of the thin shell mold 1 is disposed at a vacuum state. Then, the air is introduced into the pressure chamber 2 such that the pressure chamber 2 is returned to the atmospheric pressure. Thus, a pressure differential is defined between the outside and the inside of the thin shell mold 1 such that the casting material is filled into the thin shell mold 1 to fill the inner space of the thin shell mold 1. Then, the temperature control device 31 is turned off to reduce the temperature of the casting material in the thin shell mold 1. Then, the pressure in the pressure chamber 2 is increased to 80-100 KG/cm$^2$, such that the casting material is cooled under a high pressure to form the casting product 4. Then, the thin shell mold 1 is broken, and the casting product 4 is removed from the thin shell mold 1.

Accordingly, the thin shell mold 1 is compressed between the casting material and the sands 30 to form a pressure balance, thereby preventing the thin shell mold 1 from being damaged due to a pressure difference. In addition, the casting material closely press the inner wall of the thin shell mold 1, such that the casting product 4 has a smooth and clean surface. Further, the casting material is filled and casted in the thin shell mold 1 by a pressure differential, and is cooled under a positive pressure to form the casting product 4, thereby preventing the thin shell mold 1 from being broken when subjected to the pressure. Further, the thin shell mold 1 has a small thickness to save the cost of material.

In experiment, the present invention provides testing data as follows.

The casting material is disposed at a liquid state and is not fully filled with the thin shell mold 1, the pressure chamber 2 is under a negative pressure of −0.05 MPA, and an inert gas is introduced into the pressure chamber 2 to increase the pressure in the pressure chamber 2. The pressure resistant capacity of the thin shell mold 1 corresponds to the thickness of the thin shell mold 1 and the applied pressure, and the table of the thickness versus pressure of the thin shell mold 1 is listed as follows.

| | pressure | | | | |
|---|---|---|---|---|---|
| thickness | 15 kg/cm$^2$ | 20 kg/cm$^2$ | 30 kg/cm$^2$ | 40 kg/cm$^2$ | 50 kg/cm$^2$ |
| 0.5 mm | ○ | ○ | ○ | X | X |
| 1.0 mm | ○ | ○ | ○ | X | X |
| 1.5 mm | ○ | ○ | ○ | ○ | X |
| 2.0 mm | ○ | ○ | ○ | ○ | ○ |
| 2.5 mm | ○ | ○ | ○ | ○ | ○ |

It is clear that, when the casting material is not fully filled with the thin shell mold 1, the pressure resistant capacity of the thin shell mold 1 is reduced if the thickness of the thin shell mold 1 is decreased. For example, when the thin shell mold 1 with a thickness of 0.5 mm is subjected to a pressure greater than 40 KG/cm$^2$, the thin shell mold 1 cannot tolerate the low pressure and will be broken. Thus, when the casting material is not fully filled with the thin shell mold 1, it is necessary to reduce the pressure and to keep the preheat state.

After the casting material is fully filled with the thin shell mold 1, the outside and the inside of the thin shell mold 1 reaches a pressure balance, so that the thin shell mold 1 can withstand a higher pressure, and the table of the thickness versus pressure of the thin shell mold 1 is listed as follows.

| | pressure | | | | |
|---|---|---|---|---|---|
| thickness | 80 kg/cm$^2$ | 85 kg/cm$^2$ | 90 kg/cm$^2$ | 95 kg/cm$^2$ | 100 kg/cm$^2$ |
| 0.5 mm | ○ | ○ | ○ | ○ | ○ |
| 1.0 mm | ○ | ○ | ○ | ○ | ○ |
| 1.5 mm | ○ | ○ | ○ | ○ | ○ |
| 2.0 mm | ○ | ○ | ○ | ○ | ○ |
| 2.5 mm | ○ | ○ | ○ | ○ | ○ |

It is clear that, when the casting material is fully filled with the thin shell mold 1, the thin shell mold 1 with a thickness of 0.5 mm can withstand a high pressure of 100 KG/cm$^2$, such that the thickness of the thin shell mold 1 is reduced to save the cost of material. It is appreciated that, when the thickness of the thin shell mold 1 is decreased, the heat radiation efficiency is increased.

Alternatively, when the casting material is heated to a semisolid metallic state (such as paste) and filled into the thin shell mold 1, the table of the thickness versus pressure of the thin shell mold 1 is listed as follows.

| thickness | pressure 15 kg/cm² | 20 kg/cm² | 30 kg/cm² | 40 kg/cm² | 50 kg/cm² |
|---|---|---|---|---|---|
| 0.5 mm | X | ○ | ○ | ○ | X |
| 1.0 mm | X | ○ | ○ | ○ | X |
| 1.5 mm | X | ○ | ○ | ○ | ○ |
| 2.0 mm | X | ○ | ○ | ○ | ○ |
| 2.5 mm | X | ○ | ○ | ○ | ○ |

It is clear that, the semisolid metal has a low fluidity, such that it is necessary to apply a higher pressure to squeeze the casting material when the casting material is disposed at the semisolid metallic state. However, the semisolid metal has a low deformation, such that the thin shell mold 1 with a smaller thickness can tolerate a higher pressure. In addition, the semisolid metal has a temperature lower than that of the liquid metal, such that the semisolid metal has a smaller contraction when being cooled, to obtain the casting product 4 with greater precision. Thus, the semisolid metal is the optimum choice of the thin shell mold 1.

It is appreciated that, the thin shell mold 1 is formed by a dewaxing method or by a 3-D printing machine, thereby increasing the efficiency of production. In addition, the thin shell mold 1 is used singly in the forging cast method, without needing maintenance. Further, the thin shell mold 1 is made of ceramic material having a great thermal resistance, and the sands 30 support the thin shell mold 1, such that the thin shell mold 1 withstands a high pressure and is available for casting of other metal with low fluidity.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A casting method comprising:

a first step of preparing a mold, a second step of sintering, a third step of depressurizing, a fourth step of filling, a fifth step of pressurizing, a sixth step of molding, and a seventh step of finishing work;

wherein:

the first step includes preparing a thin shell mold and a pressure chamber;

the thin shell mold is made of ceramic material and has a thickness of 0.5-2.0 mm;

the thin shell mold has an upper end provided with a sprue having a diameter of 25-45 mm;

the thin shell mold has a periphery provided with a plurality of support brackets;

the pressure chamber has an interior provided with a furnace and a box;

the second step includes sintering the thin shell mold at a temperature under 600° C.;

the third step includes placing the thin shell mold in the box, then burying sands in the box to encompass and support the thin shell mold, then depressurizing and keeping a negative pressure in the pressure chamber at a value of −0.002 MPA to −0.05 MPA, and then heating the box under the negative pressure of the pressure chamber;

the sands closely compress the thin shell mold and the support brackets;

the outer surface of the thin shell mold touches the sands to increase a contact area between the thin shell mold and the sands;

the fourth step includes melting casting material in the furnace of the pressure chamber under the negative pressure of the pressure chamber, and then filling the casting material through the furnace and the sprue of the thin shell mold into the thin shell mold;

squeezing the casting material at a pressure of 10-20 KG/cm² to cover the sprue of the thin shell mold;

filling the casting material into the sprue of the thin shell mold to isolate an inner space of the thin shell mold from the pressure chamber, such that the inner space of the thin shell mold is disposed at a vacuum state;

the fifth step includes stopping filling the casting material, then releasing the negative pressure of the pressure chamber, then introducing air into the pressure chamber to pressurize the pressure chamber, then forming a pressure difference between the inner space of the thin shell mold and the pressure chamber to press the casting material to further flow into the inner space of the thin shell mold, and then finishing a casting work after the casting material stops flowing;

the sixth step includes reducing the temperature of the casting material in the thin shell mold, then increasing the pressure in the pressure chamber to a positive value of 80-100 KG/cm², to squeeze the casting material in the thin shell mold, and then cooling the casting material to form a casting product;

the casting material is forced by the pressure of the pressure chamber to press an inner wall of the thin shell mold, and the sands in the box are forced by the pressure of the pressure chamber to press an outer wall of the thin shell mold;

the casting material closely press the inner wall of the thin shell mold, such that the casting product has a clean surface; and the seventh step includes removing the thin shell mold from the box, then breaking the thin shell mold, and then removing the casting product from the thin shell mold.

2. The method of claim 1, wherein:

in the fourth step, the casting material in the furnace of the pressure chamber is disposed at a semisolid state;

the fifth step further includes successively heating the casting material in the thin shell mold during a period of 2-7 minutes after the casting work is finished, and then increasing the pressure in the pressure chamber to 25-30 KG/cm², such that the thin shell mold and the casting material are combined closely; and in the sixth step, when the casting material is cooled, a contraction rate of the casting material is reduced.

3. The method of claim 1, wherein the box has an upper end provided with a cover which has a through hole allowing passage of the sprue of the thin shell mold.

4. The method of claim 3, wherein the fifth step further includes applying a pressure of 5-15 KG/cm² on the cover, and then forcing the sands to apply a pressure on the thin shell mold evenly.

5. The method of claim 1, wherein in the fifth step, when the air is introduced into the pressure chamber, the pressure in the pressure chamber exceeds the atmospheric pressure and is kept at 15-50 KG/cm², during a period of 2-5 minutes, such that the casting material in the sprue of the thin shell mold is subjected to the pressure in the pressure chamber to fill the inner space of the thin shell mold, and the thin shell mold is heated successively.

* * * * *